United States Patent [19]

Hanagan

[11] 3,997,749

[45] Dec. 14, 1976

[54] ELECTRIC VEHICLE EMERGENCY POWER DISCONNECT SWITCH

[75] Inventor: Michael W. Hanagan, Somers, Conn.

[73] Assignee: Corbin Gentry Inc., Somersville, Conn.

[22] Filed: Feb. 13, 1975

[21] Appl. No.: 549,839

[52] U.S. Cl. ..... 200/162; 200/321

[51] Int. Cl.[2] ..... H01H 1/42

[58] Field of Search ..... 200/162, 161, 153 F, 200/318, 321, 48 KB; 307/10 AT, 10 BP, 10 R

[56] References Cited

UNITED STATES PATENTS

| | | | |
|---|---|---|---|
| 1,127,442 | 2/1915 | Horton | 200/162 |
| 2,277,671 | 3/1942 | Williams et al. | 200/162 |
| 2,513,172 | 6/1950 | Hassay | 200/162 |
| 2,871,440 | 1/1957 | Hart | 200/162 |
| 3,345,485 | 10/1967 | Engel | 200/48 KB |
| 3,525,838 | 8/1970 | Rusenko | 200/162 |

*Primary Examiner*—Herman Hohauser

[57] ABSTRACT

A disconnect means is provided which is particularly suited to be employed in connection with an electrically powered motor vehicle for purposes of effecting an emergency disconnect of the electrical power circuit thereof. The subject disconnect means includes a knife switch movable between a normally closed position and an open position, latching means operable to hold the knife switch in the normally closed position thereof, first and second terminal means, actuator means operable for causing the knife switch to move from the normally closed to the open condition thereof, reset means and enclosure means. The latching means includes a clevis suitably mounted on the second terminal means for movement between a latching condition wherein the clevis is in engagement with the knife switch and an unlatching condition wherein the clevis is disengaged from the knife switch. The actuator means is operatively connected to the clevis so as to be capable of causing the clevis to move between the latching and the unlatching conditions thereof. The reset means is operatively connected to the knife switch and is required to be employed for purposes of effecting the resetting of the knife switch, i.e., to cause the knife switch to move between the open position and the normally closed position thereof.

9 Claims, 3 Drawing Figures

ELECTRIC VEHICLE EMERGENCY POWER DISCONNECT SWITCH

BACKGROUND OF THE INVENTION

In recent years, there has developed a noticeable upward trend in the number of people who are devoting a significant amount of their time to recreational pursuits of one type or another. One of these recreational pursuits is that of motorcycling. The extent of interest which exists in motorcycling is clearly shown by the rapid increasing number of registrations of this type of motor vehicle. There are a variety of ways in which motorcyles are being used. Namely, some people employ motorcycles merely as a recreational vehicle. Others are interested in participating in the various racing events for motorcycles which are held in large numbers particularly during the summer months in different portions of the country. In addition, many organizations which are involved in public safety such as police departments, etc. have purchased motorcycles for their own use as a means of assisting them to meet their assigned responsibilities. Finally, recently when the gasoline shortage became pronounced throughout this country, many people turned to motorcycles as an alternate mode of transportation to get to and from work, etc. because of the fact that motorcycles are noted for their economical fuel performance.

Concomitant with the rise in interest paid to motorcycles, there has been some attention given to making changes in the nature of the construction of the motorcycles. This has led to a proliferation of different types of motorcycles as well as to the many different models of each type which are presently being marketed. As a result, the potential purchaser of a motorcycle has practically an unlimited selection to choose from. In addition to the so-called original equipment manufacturers who manufacture and sell motorcycles as complete units, there also exists a number of other manufacturers who specialize in the manufacture only of different ones of the major components which are embodied in a motorcycle. The latter manufacturers offer their products to potential purchasers as components which can be substituted in the motorcycle for original equipment components provided therein. As a result of the availability of the latter type of products, a motorcycle operator by purchasing such equipment and embodying it in his motorcycle is capable often of changing almost completely the entire character of his motorcycle.

Notwithstanding the fact that some changes have been made in the construction of motorcycles here to date, by and large these changes have been in the nature of matters of appearance rather than in matters of structure. More specifically, apart from notable advances which have been made in recent years in the construction of motorcycle seats, little has changed heretofore in the basic design of motorcycles from a structural standpoint.

However, because of the continuing high price of gasoline and because internal combustion engines are known to produce exhaust products that are deleterious to the environment, there has been some interest exhibited in providing a motorcycle which would be powered by some means other than an internal combustion engine. In this regard, one such alternative power source for the conventional gasoline powered motorcycle is a motorcycle powered by electricity. To this end, there has now been produced and is presently being commercially marketed an electrically powered motorcycle. The latter is powered by an electric motor which in turn is connected in electrical circuit relation with a multiplicity of rechargeable storage batteries.

In providing an electrically powered motorcycle, there are a number of design considerations which must be borne in mind. For instance, consideration must be given to providing means operable for purposes of effecting control over the operation of the aforementioned electric motor. In this connection, a need exists to be able to adjust the speed of the motorcycle. Also, there is a need to be able to adjust the rate of acceleration and deceleration thereof as well as to enable the motorcycle to cruise at any speed within the motorcycle's capability. Most importantly however, it is desirable that means be provided which are operable to effect an interruption in the electrical power circuit in the event that the normal operating controls of the electrically powered motorcycle fail or fuse.

Accordingly, it is an object of the present invention to provide a novel and improved disconnect means operable to effect an interruption in an electrical power circuit.

It is another object of the present invention to provide such a disconnect means which is particularly suited to be utilized in connection with an electrically powered motor vehicle for purposes of effecting an emergency disconnect of the electrical power circuit thereof when the normal operating controls of the vehicle have short-circuited, welded, burned out, etc.

A further object of the present invention is to provide such a disconnect means which is characterized in the fact that the disconnect means has no electrical dependency and therefore remains operative when all electrical power has failed or short-circuited in the electrically powered motor vehicle.

A still further object of the present invention is to provide such a disconnect means which is further characterized in that the disconnect means can only be reset manually thereby obviating any possibility that an accidental resetting of the disconnect means could take place.

Yet another object of the present invention is to provide such a disconnect means which embodies means operable for providing a visual indication of the operating state of the disconnect means.

Yet still another object of the present invention is to provide such a disconnect means which is of simple construction, easy to employ, relatively inexpensive to manufacture, and readily adaptable for employment in all forms of electrically powered motor vehicles.

SUMMARY OF THE INVENTION

It has now been found that the foregoing and related objects can be readily attained in a disconnect means which is particularly suited to be employed in connection with an electrically powered motor vehicle for purposes of effecting an emergency disconnect of the electrical power circuit of the vehicle. The subject disconnect means is capable of being operated remotely and manually when the normal operating controls of the electrically powered motor vehicle fail or fuse. The subject disconnect means includes a knife switch movable between a normally closed position and an open position, latching means operable to maintain the knife switch in the normally closed position thereof, first and second terminal means, actuator means operable for causing the knife switch to move between the normally closed position and the open position thereof, reset means and enclosure means. The knife switch has one end thereof operatively connected to the first terminal means so as to be connected in electrical circuit relation therewith and so as to be mounted for pivotal movement thereabout. When occupying the normally closed position thereof, the knife switch has the other end thereof operatively engaged with the second terminal means so as to be effective to complete an electrical circuit between the first and second terminal means. The latching means includes a clevis suitably mounted on the second terminal means for movement between a latching condition wherein the clevis is in engagement with the knife switch and an unlatching condition wherein the clevis is disengaged from the knife switch. The actuator means is operatively connected to the clevis so as to be capable of causing the latter to move between the latching and the unlatching positions thereof. The reset means is operatively connected to the knife switch and is required to be employed for purposes of effecting the resetting of the knife switch, i.e., to cause the knife switch to move between the open position and the normally closed position thereof. Finally, an enclosure means is preferably provided for purposes of housing at least most of the various operating components described hereinabove which are encompassed within the disconnect switch of the present invention.

In accord with the preferred embodiment of the invention, the knife switch comprises an elongated blade member. The first and second terminal means each include an L-shaped member terminating at one end in an upstanding bifurcated contact portion. The knife switch has one end thereof mounted between the two legs of the bifurcated contact portion of the first terminal means and is supported for pivotal movement therebetween by means of a pin, the ends of which are suitably supported in the two legs of the aforereferenced bifurcated contact portion of the first terminal means. More specifically, the knife switch is mounted for pivotal movement between a first position corresponding to the closed condition thereof wherein the other end of the knife switch is received in frictional engagement with and is located between the the two legs of the bifurcated contact portion of the second terminal means, and a second position corresponding to the open condition of the knife switch wherein the latter is disengaged from the bifurcated contact portion of the second terminal means, i.e., the aforesaid other end of the knife switch is removed from between the two legs of the bifurcated contact portion of the second terminal means. The other end end of each of the L-shaped members of the first and second terminal means is suitably mounted in insulated relation on one of the inside walls of the enclosure means. Moreover, each of the first and second terminal means is provided with a terminal post. The latter terminal post of the first and second terminal means are connected in electrical circuit relation by means of a conventional electrical conductor. Also, in accord with the preferred form of the invention, a capacitor, fuse, circuit breaker or other arc extinguishing means is preferably connected in series electrical circuit relation with the terminal posts of the first and second teminal means by being connected to the aforedescribed electrical conductor at a point intermediate the ends of the latter. The latching means as set forth previously herein includes a clevis which is operable to maintain the knife switch in the closed condition thereof. To this end, the clevis is pivotably mounted on the bifurcated contact portion of the second terminal means by means of a pin which has the ends thereof received in the two legs of the latter referenced bifurcated contact portion. Consequently, the clevis is pivotal relative to the bifurcated contact portion of the second terminal means between a first position corresponding to the latching condition thereof wherein the medial portion of the clevis is located in juxtaposed relation to the free ends of the two legs of the bifurcated contact portion and a second position corresponding to the unlatching condition of the clevis wherein the medial portion of the latter is located in spaced relation to the free ends of the two legs of the bifurcated contact portion of the second terminal means. The actuator means is operatively connected to the clevis so as to be operable to move the latter from the latching to the unlatching condition thereof. More specifically, the actuator means includes a pull cord having a suitable grasping means provided at one end thereof capable of being conveniently positioned so as to be readily accessible for grasping by the operator of the electrically powered motor vehicle. For this purpose, at least a portion of the pull cord is passed through a suitable opening provided therefor in one of the walls of the enclosure means so that the grasping means and a portion of the pull cord are located externally of the enclosure means. The other end of the aforedescribed pull cord is attached to one end of a return spring, with the other end of the latter in turn being attached to the clevis. The return spring functions to return the clevis to a position wherein the medial portion of the clevis is located in closely spaced relation to the bifurcated contact portion of the second terminal means upon release of the pull cord by the operator of the electrically powered motor vehicle after the actuation of the actuator means thereby. The reset means comprises a plunger generally cylindrical in shape which has a suitably dimensioned slot formed intermediate the ends thereof. The plunger is suitably mounted for movement in opposing walls of the enclosure means whereby by noting the extent to which the plunger projects outwardly of one of the aforesaid opposing walls it can be readily determined whether the knife switch is in the normally closed or the open condition thereof. There is received in the latter described slot in the plunger the medial portion of the knife switch. More specifically, the medial portion of the knife switch is operatively connected to the plunger by means of a pin which is passed through the knife switch and which has the ends thereof received in the side walls of the plunger. Accordingly, movement of the plunger is transmitted through the latter referenced pin to the knife switch for purposes of causing the knife switch to move from the open condition to the closed condition thereof, i.e., to be reset. In addition, there is preferably cooperatively associated with the plunger a coil spring which surrounds the plunger and bears against the knife switch so as to be operable to apply a biasing force against the knife switch tending to bias the latter to its open condition. More specifically, the function of the latter referenced spring is to effect a fast opening of the knife switch when the clevis is moved to its unlatching condition in an effort thereby to minimize the extent to which arching occurs between the knife switch and the bifurcated contact portion of the second terminal means.

DETAILED DESCRIPTION OF THE ILLUSTRATED EMBODIMENT

Figure 1:
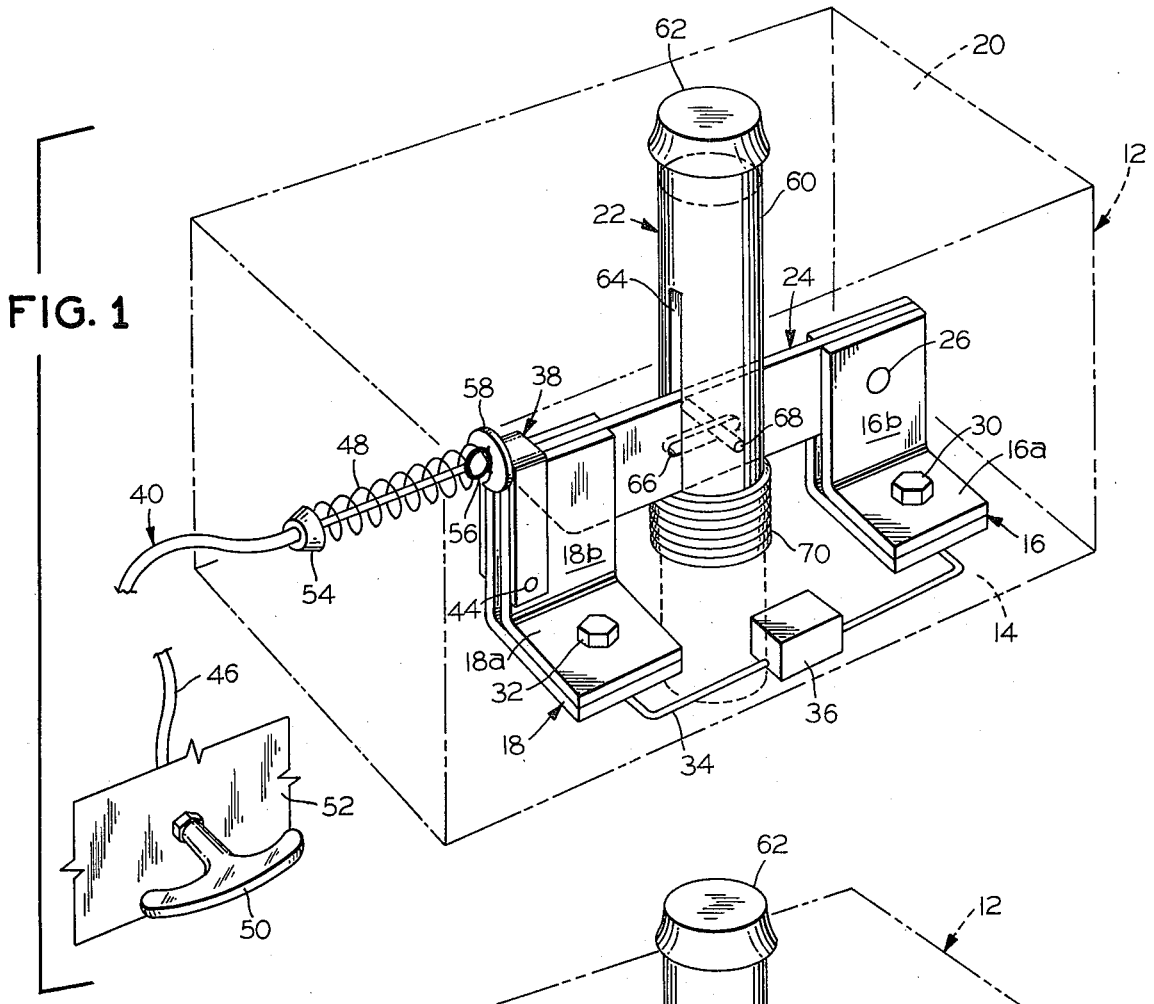
FIG. 1 is a perspective view with parts broken away for purposes of clarity of illustration of a disconnect means constructed in accordance with the present invention and particularly suited for utilization in an electrically powered motor vehicle, illustrated with the knife switch thereof in a normally closed condition.
Figure 2:
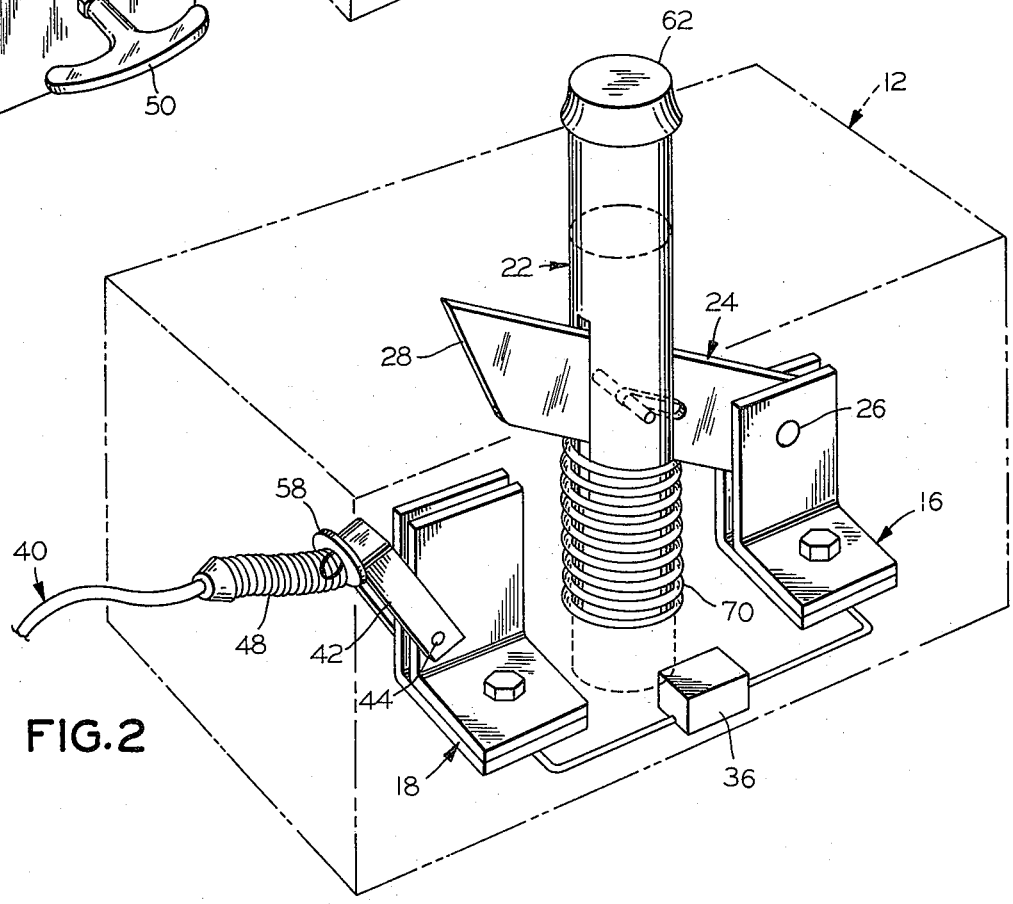
FIG. 2 is a perspective view with parts broken away for purposes of clarity of illustration of a disconnect means constructed in accordance with the present invention and particularly suited for utilization in an electrically powered motor vehicle, illustrated with the knife switch thereof in an open condition.

Referring now to the drawings and more particularly FIGS. 1 and 2 thereof, there is illustrated therein a disconnect means, generally designated by reference numeral 10, constructed in accordance with the present invention. The disconnect means 10 is particularly suited to be employed in connection with an electrically powered motor vehicle for purposes of effecting an emergency disconnect of the electrical power circuit thereof. More specifically, the disconnect means 10 is designed to be operated remotely and manually when the normal operating controls of the electrically powered motor vehicle fail or fuse. Moreover, the principle of operation of the disconnect means 10 is such that it is capable of being utilized in substantially all forms of electrically powered motor vehicles. In addition, the principle of operation of the disconnect means 10 is such that it remains operative when all electrical power has failed or shortcircuited in the electrically powered motor vehicle by virtue of the fact that the disconnect means 10 has no electrical dependency.

With further reference to FIGS. 1 and 2 of the drawings, as illustrated therein the disconnect means 10 preferably includes an enclosure means 12. The enclosure means 12 in accord with the illustrated form thereof comprises a closed container which is operable as a housing for most of the operating components of the disconnect means 10. More specifically, the enclosure means 12 is composed of a multiplicity of suitably dimensioned wall members which are joined together along the edges thereof. Mounted on one of the wall members, namely the wall member 14, in spaced relation to each other are a first terminal means 16 and a second terminal means 18. Moreover, the aforereferenced wall member 14 also functions as a support along with the wall member 20 for the rest means 22, which will be more fully described hereinafter, of the disconnect means 10. As depicted in FIGS. 1 and 2 of the drawings, the wall members 14 and 20 comprise opposing wall members of the enclosure means 12.

As best understood with references to FIGS. 1 and 2 of the drawings, the first and second terminal means 16 and 18, respectively, each consists of a substantially L-shaped member. More specifically, each of the L-shaped members includes a first leg portion 16*a* and 18*a*, respectively, and a second leg portion 16*b* and 18*b*, respectively, with the pair of leg portions 16*a* and 16*b* and the pair of leg portions 18*a* and 18*b* each being formed integral with each other so as to form a unitary member and so as to provide substantially a right angle between the corresponding leg portions of each of the first and second terminal means 16 and 18, respectively. Moreover, the leg portions 16*a* and 16*b* of the first terminal means 16 and the leg portions 18*a* and 18*b* of the second terminal means 18 are each formed of a suitable electrically conductive material whereby to permit electrical current to flow therethrough. In addition, as depicted in FIGS. 1 and 2 of the drawings, the leg portions 16*a* and 18*a* are each suitably fastened to the inside surface of the wall member 14 in spaced relation to each other and so that the leg portions 16*b* and 18*b* of the first and second terminal means 16 and 18, respectively, both lie in a common plane, and with the latter plane extending substantially at right angles to the plane of the wall member 14. Although not depicted in the drawings in the interest of maintaining clarity of illustration therein, it is to be understood that suitable insulation means are interposed between the external surface of the leg portions 16*a* and 18*a* and the inside surface of the wall member 14. For a purpose yet to be described, the leg portions 16*a* and 16*b* and the leg portions 18*a* and 18*b* of the first and second terminal means 16 and 18, respectively, are each formed of a double thickness of conductive material.

Continuing with the description of the first and second terminal means 16 and 18, respectively, the corresponding leg portions 16*b* and 18*b* thereof are suitably constructed so that each take the form of a bifucated contact portion. More specifically, the double thickness of conductive material of which each of the leg portions 16*b* and 18*b* is formed are suitably spaced apart relative to each other whereby to create a space at the center of each of the leg portions 16*b* and 18*b* extending substantially the entire length thereof measured from the free end of each of the leg portions 16*b* and 18*b* to the point whereat the latter referenced leg portions are joined integrally to the leg portions 16*a* and 18*a*, respectively. Moreover, the aforedescribed space created at the center of each of the leg portions 16*b* and 18*b* is suitably dimensioned so as to be operable in a manner now to be described.

With reference to FIGS. 1 and 2 of the drawings, the spacing which exists at the center of the leg portions 16*b* and 18*b* is suitably dimensioned so as to enable a knife switch 24 to be received therewithin. The knife switch 24 comprises an elongated member which is suitably supported within the enclosure means 12 so as to be movable between a first position corresponding to the normally closed condition thereof, the latter condition in turn being operable to establish the noninterrupting state of the disconnect means 10, and a second position corresponding to the open condition of the knife switch 24, the latter condition in turn also being operable to establish the interrupting state of the disconnect means 10. More specifically, the knife switch 24 is suitably supported within the enclosure means 12 so as to be pivotable within the plane in which the leg portions 16*b* and 18*b of the first and second terminal means 16 and 18, respectively, lie. Namely, the knife switch 24 is positioned relative to the first and second terminal means 16 and 18, respectively, so as to be movable within the spaces created by the bifurcation of the leg portions 16b* and 18*b*. Moreover, as can be seen with reference to FIGS. 1 and 2 of the drawings, the knife switch 24 has one end thereof received between the bifurcated segments of the leg portion 16*b* for pivotal movement relative thereto. The latter referenced movement is preferably accomplished through the use of a pivot pin 26. The latter pin 26 extends through the knife switch 24 so as to be affixed therewith against movement relative thereto, and with the ends of the pivot pin 26 being received in suitably dimensioned openings (not shown) provided for this purpose substantially at the center of each of the bifurcated segments of the leg portion 16*b*. As the aforesaid one end of the knife switch 24 which is operatively connected to the leg portion 16*b* pivots about the pivot pin 26, the other end of the knife switch 24 is caused to move between a first position wherein the aforesaid other end of the knife switch 24 is positioned within the bifurcated segments of the leg portion 18*b* in the manner depicted in FIG. 1 of the drawings, and a second position wherein the aforesaid other end of the knife switch 24 is located outwardly of the free end of the leg portion 18*b* in the manner depicted in FIG. 2 of the drawings. In this connection, it is to be understood that the spacing between the bifurcated segments of the leg portion 16*b* is such as to permit the aforereferenced one end of the knife switch 24 to freely pivot therewithin, while the spacing between the bifurcated segments of the leg portion 18*b* is such that when the aforesaid other end of the knife switch 24 is positioned therebetween the manner of FIG. 1 of the drawings, the side surfaces of the knife switch 24 are in touching relation with the inner surfaces of the bifurcated segments of the leg portion 18*b*. In accord with the illustrated form of the invention, the aforesaid other end of the knife switch 24 is preferably cut away on a diagonal running from the top edge of the knife switch 24 to the bottom edge thereof, as viewed with reference to FIG. 1 of the drawings. Consequently, the forward end of the knife switch 24 is inclined inwardly from the top edge to the bottom edge as depicted at 28 in FIG. 2 of the drawings whereby to facilitate entry of the knife switch 24 between the bifurcated segments of the leg portion 18*b* of the second terminal means 18.

Completing the description of the components operatively associated with the first and second terminal means 16 and 18, respectively, each of the latter is provided with a terminal post 30 and 32, respectively. The latter terminal posts 30 and 32 are suitably secured through the use of any conventional attaching means to the leg portions 16*a* and 18*a*, respectively, substantially at the center thereof so as to be in electrical circuit relation therewith. Moreover, the terminal posts 30 and 32 are connected in electrical circuit relation with each other by means of a conventional electrical conductor 34 which has one end thereof connected to the terminal post 30 and the other end thereof connected to the terminal post 32. In accord with the preferred embodiment of the invention, some form of arc quenching means is preferably connected in electrical circuit relation with the electrical conductor 34 at a point intermediate the ends thereof. The aforesaid arc quenching means is schematically depicted in FIGS. 1 and 2 of the drawings by means of the box appearing therein which is identified by the reference numeral 36, and may take the form for instance of a capacitor operable t reduce opening arc, or a small capacity sacrificial fuse, or a small resetting circuit breaker.

The major components included in the disconnect means 10 which remain yet to be described comprise the latching means 38, the actuator means 40, and the reset means 22 which was mentioned previously hereinabove. Considering each of the latter referenced components in turn commencing with the latching means 38, the latter includes a clevis 42 and means 44 mounting the clevis 42 for pivotal movement relative to the second terminal means 18. More specifically, the clevis 42 consists of a U-shaped shackle having suitable openings (not shown) provided adjacent the free ends of the two legs which with an interconnecting medial portion define the configuration of the clevis 42. As best understood with reference to FIGS. 1 and 2 of the drawings, the clevis 42 is mounted on the second terminal means 18 and more particularly the upstanding leg portion 18*b* thereof with the two legs of the clevis 42 positioned externally of and on either side of the leg portion 18*b*. The mounting means 44 which may take the form of any suitable conventional type of attachment means, in accord with the present invention consists of a conventional pivot pin which is passed through the aforereferenced openings (not shown) provided therefor in the two legs of the clevis 42 and extends through the leg portion 18*b* of the second terminal means 18. The pivot pin 44 is suitably dimensioned so as to be retained positioned relative to the clevis 42 and the leg portion 18*b* in the aforedescribed manner through the use of any conventional means commonly employed for this purpose such as for instance by utilizing a frictional fit between the pivot pin 44 and the side walls of the openings (not shown) through which the pivot pin 44 extends in the clevis 42 and the leg portion 18*b*. The pivot pin 44 as depicted in the drawings is operable to permit the clevis 42 to pivot between a latching condition as depicted in FIG. 1 of the drawings and an unlatching condition as illustrated in FIG. 2 of the drawings. To establish the latching condition of the clevis 42, the knife switch 24 is first positioned so that the free end thereof is received within the bifurcated segments of the leg portion 18*b*. With the knife switch 24 occupying the aforedescribed position, the clevis 42 is pivoted about the pivot pin 44 so that the medial portion of the clevis 42 is positioned in overlying relation to the free end of the leg portion 18*b*. As such, the medial portion of the clevis 42 operates to hold the knife switch 24 positioned within the bifurcated segments of the leg portion 18*b* against the biasing force being applied to the knife switch 24 by means yet to be described. To establish the unlatching condition of the clevis 42, the latter is caused to be pivoted in a manner yet to be described about the pivot pin 44 so that the medial portion of the clevis 42 is spaced outwardly away from the free end of the leg portion 18*b*, i.e., in the manner illustrated in FIG. 2 of the drawings, so that the knife switch 24 is free to pivot about the pivot pin 26 so that the free end of the knife switch 24 moves out from between the bifurcated segments of the leg portion 18*b* of the second terminal means 18 through the operation of means yet to be described.

Proceeding now to a description of the means through the operation of which the clevis 42 is caused to move between the latching condition and the unlatching condition thereof, reference will now be had in this connection to a description of the actuator means 40 which is operable for the aforedescribed purpose. The actuator means 40 in a manner which will now be described is operatively connected at one end to the clevis 42 and with the other end thereof being suitably located so as to be readily accessible for actuation by the operator of the electrically powered motor vehicle while the latter is in operation. To this end, the actuator means 40 includes a pull cord 46 having one end thereof fastened to one end of a clevis return spring 48 and the other end thereof attached to a suitably configured grasping means 50. In accord with the illustrated embodiment of the invention, the pull cord 46 consists of an internal cable received coaxially within an external cable. Moreover, the grasping means 50 consists of a T-shaped handle which is suitably fastened through the use of any conventional form of attachment means to the internal cable of the pull cord 46 whereby when a pulling force is applied to the grasping means 50 a corresponding movement is transmitted to the pull cord 46. As schematically depicted in FIGS. 1 and 2 of the drawings, the T-shaped handle 50 is designed to be located in juxtaposed relation to the dashboard 52 of the electrically powered motor vehicle. More specifically, the T-shaped handle 50 is suitably supported on the dashboard 52 through the use of any suitable conventional form of supporting means so as to be accessible for grasping by the operator of the electrically powered motor vehicle and so as to be movable relative to the dashboard 52. It is of course to be understood that the dashboard 52 is provided with a suitably dimensioned opening operable to permit the pull cord 46 to be passed therethrough. In addition, obviously the pull cord 46 is made of sufficient length whereby to be capable of extending from the dashboard 52 to the clevis return spring 48.

Continuing with a description of the nature of the construction of the actuator means 40, and more particularly the manner in which the pull cord 46 is operatively connected to the clevis return spring 48 and the latter in turn is connected to the clevis 42, reference will again be had for this purpose to FIGS. 1 and 2 of the drawings. As best understood with reference thereto, the external cable at the end thereof which is not operatively associated with the T-shaped handle 50 terminates in a sheath mounting 54. The latter mounting 54 consists of a member of enlarged diameter, the latter corresponding to the diameter of the clevis return spring 48. The sheath mounting 54 functions as a seat for one end of the clevis return spring 48. The internal cable which comprises a part of the pull cord 46 is of greater length than the external cable which comprises the other portion of the pull cord 46. More specifically, the internal cable of the pull cord 46 is of sufficient length so as to extend through the center of the clevis return spring 48 from one end to the other thereof. Moreover, the end of the internal cable of the pull cord 46 which is not attached to the T-shaped handle 50 is fastened to an insulated eyelet 56. The latter eyelet 56 is secured to an insulated washer 58 and therethrough to the medial portion of the clevis 42. The washer 58 also functions as a seat for the other end of the clevis return spring 48,. Insofar as concerns the mode of operation of the actuator means 40, when a pulling force is applied to the T-shaped handle 50 causing the latter to move outwardly away from the dashboard 52, the movement thereof is imparted also to the internal cable of the pull cord 46 causing the internal cable to move relative to the external cable. The resulting movement of the internal cable of the pull cord 46 in turn is transmitted through the insulated eyelet 56 and the insulated washer 58 to the clevis 42 causing the latter to move from the position thereof depicted in FIG. 1 of the drawings, i.e., the latching condition thereof, to the position thereof depicted in FIG. 2 of the drawings, i.e., the unlatching condition thereof wherein the knife switch 24 moves to its nonengaged position relative to the leg portion 18b of the second terminal means 18, i.e., the interrupting state of the disconnect means 10. As best understood from a comparison of FIGS. 1 and 2 of the drawings, as the T-shaped handle 50 is moved outwardly away from the dashboard 52, the clevis return spring 48 is compressed between the two seats against which the ends of the spring 48 bear, namely, the sheath mounting 54 and the insulated washer 58. Consequently, when the T-shaped handle 50 is released, the stored energy embodied in the compressed clevis return spring 48 operates to cause the clevis 42 to return to a position relative to the leg portion **18*b* wherein the former can readily be positioned when desired in its latching condition. Also, the clevis return spring 48 functions in addition to cause the T-shaped handle 50 to be returned to a position wherein the latter is located in juxtaposed relation to the surface of the dashboard 52.**

Turning now to a description of the reset means 22, the latter as noted above is utilized for purposes of effectuating a resetting of the knife switch 24, i.e., returning the disconnect means 10 to its noninterrupting state after an emergency interruption of the electrical power circuit of the electrically powered motor vehicle has been effected through the operation thereof. The reset means 22 includes a cylindrically-shaped plunger 60 which is made of sufficient length so as to be capable of traversing the interior of the enclosure means 12 and project outwardly of the opposing wall members 14 and 20. In this connection, the latter wall members 14 and 20 are each provided with a suitably dimensioned opening (not shown) formed substantially at the center thereof and in aligned relation to each other for purposes of receiving therein the plunger 60. At one end thereof, the plunger 60 has mounted thereon, through the use of any suitable conventional form of mounting means operable for mounting one member to another such as by establishing a frictional fit therebetween, an insulated cap 62. The latter cap 62 is designed to have applied thereto, in a manner yet to be described, a pushing force operable to move the plunger 60 between the release position thereof and the resetting position thereof.

With further reference to the nature of the construction of the plunger 60, the latter as illustrated in FIGS. 1 and 2 of the drawings, has an elongated slot 64 formed therethrough substantially at the center thereof. More specifically, the slot 64 is suitably configured so as to permit the knife switch 24 to be received therein. The knife switch 24 and the plunger 60 are operatively connected together so as to permit the knife switch 24 and the plunger 60 to move together as a unit while yet allowing the knife switch 24 to also move relative to the plunger 60. The aforereferenced operative connection between the knife switch 24 and the plunger 60, in accord with the illustrated embodiment of the invention, is preferably accomplished through the use of a pin and slot connection. Namely, the knife switch 24 has a slot 66 formed therein which is suitably located substantially at the midpoint of the knife switch 24 whereby when the knife switch 24 is received within the slot 64 in the plunger 60, the slot 66 in the knife switch 24 is located within the interior of the plunger 60. Moreover, the slot 66 in the knife switch 24 is suitably dimensioned so as to permit a pin 68 to extend therethrough. The latter pin 68 has the ends thereof suitably retained within the side walls of the plunger 60. Consequently, the pin 68 is operative to maintain the knife switch 24 and the plunger 60 secured together whereby when movement is imparted to either of the two members, i.e., the knife switch 24 or the plunger 60 the pin 68 is effective to transmit this movement to the other of the two members, namely, the plunger 60 or the knife switch 24, respectively. As will be best understood with reference to the drawings, and more particularly FIGS. 1 and 2 thereof, in order to permit the knife switch 24 to pivot about the pivot pin 26 it is necessary that relative movement be permitted to take place between the knife switch 24 and the plunger 60. This capability for relative movement is provided through the use of the aforedescribed slot 66 which is formed in the knife switch 24. More specifically, when the knife switch 24 is caused to pivot about the pivot pin 26, the pin 68 is capable of sliding within the slot 66 as required. In this connection, the slot 66 is obviously suitably dimensioned so as to be sufficiently long to permit the knife switch 24 to pivot about the pivot pin 26 in an upwardly direction as viewed with reference for instance to FIG. 2 of the drawings whereby the knife switch 24 is completely removed from between the bifurcated segments of the leg portion 18b of the second terminal means 18. In addition, it should also be noted here that the slot 64 with which the plunger 60 is provided is also formed so as to have a sufficient length whereby to allow the knife switch 24 to move therein to a sufficient extent to permit the free end of the knife switch 24 to move clear of the leg portion 18b of the second terminal means 18.

For purposes of completing the description of the disconnect means 10, it will be noted with reference to FIGS. 1 and 2 of the drawings that a coil spring 70 is preferably provided mounted on the plunger 60. More specifically, the coil spring 70 is preferably received on the plunger 60 whereby one end of the coil spring 70 bears against the bottom edge, as viewed with reference to either FIG. 1 or FIG. 2 of the drawings, of the knife switch 24 and with the other end of the coil spring 70 bearing against the inside surface of the wall member 14 of the enclosure means 12. The coil spring 70 is operable to impart a biasing force to the knife switch 24 tending to bias the latter to its open condition. Namely, as best understood with reference to FIG. 1 of the drawings, when the knife switch 24 is being maintained in the closed condition thereof through the action of the clevis 42, the coil spring 70 is held captured in a compressed state between the bottom edge of the knife switch 24 and the wall member 14. Consequently, when the clevis 42 is moved to its unlatching condition through the operation of the actuator means 40 thereby freeing the knife switch 24 for movement out from between the bifurcated segments of the leg portion 18*b*, the stored energy embodied in the coil spring 70 is released with the result that through operation of the coil spring 70 the aforedescribed movement of the knife switch 24 is produced, i.e., a quick arc-limiting opening of the knife switch 24 is effected. Obviously, in order to reset the knife switch 24 to the normally closed position thereof it is necessary to overcome the bias of the coil spring 70. i.e., cause the latter to once again become compressed.

A final function performed by the reset means 22 which should be noted at this point is that of a visual indicator. Namely, by noting the extent by which the cap 62 mounted on one end of the plunger 60 is spaced from the outer surface of the wall member 20 of the enclosure means 12, it is possible to determine whether the knife switch 24 is in a normally closed condition thereof signifying that the disconnect means 10 is in a non-circuit interrupting condition or in the open condition thereof signifying that the disconnect means 10 is in a circuit interrupting condition. More specifically, when the cap 62 as shown in FIG. 1 of the drawings is positioned in relatively close proximity to the outer surface of the wall member 20, the knife switch 24 is in its normally closed condition, and when the cap 62 as illustrated in FIG. 2 of the drawings is located at a relatively considerably spaced distance from the outer surface of the wall member 20, the knife switch 24 is in an open condition.

Figure 3:
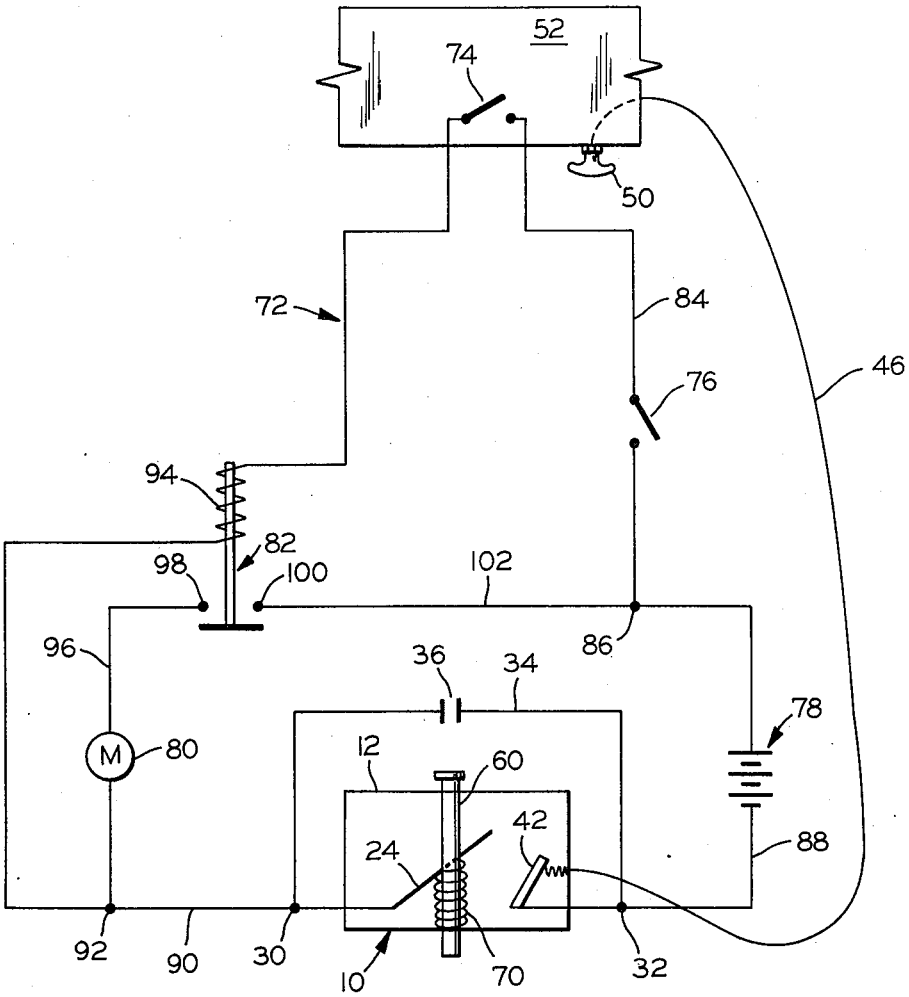
FIG. 3 is a schematic electrical circuit diagram of an electrical power circuit for an electrically powered motor vehicle embodying a disconnect means constructed in accordance with the present invention operable for effecting an emergency interruption of the electrical power circuit of the vehicle.

There will now be set forth a description of the intended mode of operation of the disconnect means 10 when employed for purposes of effecting an emergency interruption of the electrical power circuit of an electrically powered motor vehicle. For purposes of this description, it will be assumed that the disconnect means 10 is connected in electrical circuit relation with the electrical power circuit of an electrically powered motor vehicle. Moreover, it will be assumed that the terminal posts 30 and 32 of the first and second terminal means 16 and 18, respectively, are being utilized for purposes of effecting the desired connection of the disconnect means 10 in circuit relation with an electrical power circuit. One such typical electrical power circuit with which the subject disconnect means 10 of the present invention is capable of being employed which will be described hereinafter is schematically illustrated in FIG. 3 of the drawings. At this point however, it will suffice merely to note that the disconnect means 10 is connected in series circuit relation in an electrical power circuit. Under the normal operating conditions, the knife switch 24 occupies the position thereof corresponding to the normally closed condition of the knife switch 24 whereby an electrical circuit is completed from the terminal post 30 through the first terminal means 16 and the leg portion 16*b* thereof, then through the knife switch 24 to the leg portion 18*b*, and finally from the leg portion 18b through the second terminal means 18 to the terminal post 32. As noted above, suitable electrical connections are in turn effected between the terminal posts 30 and 32 and the electrical power circuit. Obviously, although not shown in FIGS. 1 and 2 of the drawings in the interest of maintaining clarity of illustration therein, suitable openings are provided in the wall members of the enclosure means 12 whereby to enable the aforedescribed electrical connections between the terminal posts 30 and 32 and the electrical power circuit to be effected. With the knife switch 24 positioned relative to the first and second terminal means 16 and 18, respectively, in the manner described above, i.e., as depicted in FIG. 1 of the drawings, the electrically powered motor vehicle is in condition to be operated. More specifically, under the control of the operator of the electrically powered motor vehicle and as desired by the latter, electrical power is supplied by means of the electrical power circuit to the electrical motor of the vehicle which in turn is operable to drive the wheels of the motor vehicle in the desired direction and at the desired speed. For purposes of this description, assume now that a malfunction occurs in the operation of the electrical power circuit causing the latter to fail. When the occurrence of the latter condition is sensed, i.e., a need is deemed to be present to effect an emergency interruption of the electrical power circuit. the latter action is initiated by the operator grasping the T-shaped handle 50 and applying a pulling force thereto operable to cause the T-shaped handle 50 to be moved outwardly away from the face of the dashboard 52. This movement of the T-shaped handle 50 is in turn transmitted through the internal cable of the pull cord 46 to the clevis 42 causing the latter to be released from its latching condition, i.e., causing the clevis 42 to move from its latching to its unlatching condition. Upon the clevis 42 being released, the knife switch 24 springs from its normally closed condition, i.e., the position thereof depicted in FIG. 1 of the drawings, to the open condition thereof, i.e., the position of the knife switch 24 depicted in FIG. 2 of the drawings, in response to the biasing force being applied to the knife switch 24 by the coil spring 70. The latter movement of the knife switch 24 is desirably caused to occur rapidly in order to minimize the formation of an arc upon the opening of the electrical circuit through the opening movement of the knife switch 24. Inasmuch as the disconnect means 10 is connected in series circuit relation with the electrical power circuit of the electrically powered motor vehicle, it can be readily understood that the opening of the electrical circuit through the disconnect means 10 which is produced when the knife switch 24 is caused to move from its normally closed condition to its open condition operates to produce an interruption of the electrical power circuit. Moreover, it is to be noted here again that the disconnect means 10 is not electrically dependent thereby the disconnect means 10 constructed in accord with the present invention notwithstanding the fact that the electrical power circuit may have failed, or fused, etc., remains operative. Moreover, it is to be noted that a rapid opening of the knife switch 24 is effected through the action of the coil spring 70 thereby minimizing the extent to which arcing occurs between the knife switch 24 and particularly the bifurcated segments of the leg portion 18b of the second terminal means 18. Furthermore, in this connection suitable arc-quenching mean are employed in accord with the preferred embodiment of the invention between the terminal posts 30 and 32 of the first and second terminal means 16 and 18, respectively. Once the emergency interruption of the electrical power circuit has been effectuated in the aforedescribed manner, when the T-shaped handle 50 is released by the operator of the electrically powered motor vehicle, the clevis return spring 48 returns the clevis 42 to a position wherein the latter is located in juxtaposed relation to the free end of the leg portion 18b of the second terminal means 18. As the clevis 42 returns to the latter referenced position, inasmuch as the clevis 42 is operatively attached to the T-shaped handle 50 through the internal cable of the pull cord 46, the T-shaped handle 50 is also caused to be moved back to its normal position wherein it is located in juxtaposed relation to the face of the dashboard 52. Since the disconnect means 10 is incapable of being automatically reset, in order to effect a resetting of the disconnect means 10 when the cause for the failure of the electrical power circuit has been corrected, the reset means 22 of the disconnect means 10 must be employed for this purpose. More specifically, the resetting of the disconnect means 10 is accomplished by manually applying an inwardly directed pushing force to the cap 62 of the plunger 60 of sufficient strength to overcome the biasing force of the coil spring 70. Inasmuch as the knife switch 24 is operatively connected to the plunger 60 through the pin 68, fas the plunger 60 is caused to move inwardly, i.e., downwardly as viewed in FIG. 2 of the drawings, the knife switch 24 moves therewith. Movement of the plunger 60 as described above is continued until the knife switch 24 is received within the bifurcated segments of the leg portion 18b of the second terminal means 18, i.e., to the position thereof depicted in FIG. 1 of the drawings. With the knife switch 24 occupying the aforedescribed position, the clevis 42 is returned to its latching condition under the influence of the clevis return spring 48 and/or manipulation of the T-shaped handle 50 and therethrough the internal cable of the pull cord 46 if necessary whereupon the clevis 42 is operable to maintain the knife switch 24 in its normally closed condition and thereby the disconnect means 10 in the noncircuit interrupting condition thereof until circumstances indicate that emergency interruption of the electrical power circuit of the electrically powered motor vehicle is once again warranted.

Proceeding now with a description of the electrical circuit, generally designated by reference numeral 72, which is depicted in FIG. 3 of the drawings, the latter circuit is intended to represent a typical electrical power circuit for an electrically powered motor vehicle. More specifically, FIG. 3 is intended to schematically illustrate one application of the disconnect means 10 constructed in accord with the present invention. As shown in FIG. 3, in addition to the disconnect means 10, the electrical circuit 72 includes an ignition key switch 74, a throttle switch 76, storage battery means 78, an electric motor 80, and contactor means 82. In accord with conventional practice, the electrical circuit 72 is operable in such a manner that electrical power derived from the storage battery means 78 is utilized to power the electric motor 80, the output of which is employed in turn to drive the wheels of the electrically powered motor vehicle. Moreover, under normal operating conditions the ON and OFF condition of the electrical circuit 72 is established by the state of operation of the ignition key switch 74, throttle switch 76 and the contactor means 82. For this purpose, with reference to FIG. 3 of the drawings, one side of the ignition key switch 74 is connected in electrical circuit relation by means of electrical conductor 84 with the throttle 76 and therewith through the junction 86 in electrical circuit relation with one side of the storage battery means 78. The other side of the storage battery means 78 is connected in electrical series circuit relation by electrical conductor 88 to the terminal post 32 of the second terminal means 18 of the disconnect means 10. The other side of the disconnect means 10, namely the terminal post 30 of the first terminal means 16, is connected by means of electrical conductor 90 through junction 92 in electrical circuit relation with one side of the electric motor 80. Moreover, the electrical conductor 90 is further operative to connect the aforementioned terminal post 30 of the disconnect means 10 to one end of the coil 94 of the contactor means 82. It will be noted here that the interconnection of the terminal posts 30 and 32 by means of the electrical conductor 34 and the inclusion in this circuit of an arc limiting means 36 which may take the form of a capacitor which has been described previously hereinabove in connection with the description of the nature of the construction of the disconnect means 10 appears in FIG. 3 of the drawings. Returning to the description of the electrical circuit 72, the other side of the electric motor 80 is connected by means of electrical conductor 96 in electrical circuit relation with one terminal 98 of the contactor means 82, with the other terminal, i.e., terminal 100 of the contactor means 82 being connected in electrical circuit relation by means of electrical conductor 102 through junction 86 to the storage battery means 78. Completing the description of the electrical circuit 72 as illustrated in FIG. 3 of the drawings, electrical conductor 104 connects the other side of the coil 94 of the contactor means 82 to the other side of the ignition key switch 74. Finally, it will be noted that in accord with the illustrated form of the electrical circuit 72 appearing in FIG. 3 of the drawings, the ignition key switch 74 along with the T-shaped handle 50 of the disconnect means 10 is suitably supported on the face of the dashboard 52. Also, it is to be understood that the storage battery means 78 may consist of one or more rechargeable storage batteries.

Turning now to a description of the mode of operation of the electrical circuit 72 illustrated in FIG. 3 of the drawings, with the disconnect means 10 in a noncircuit interrupting condition, i.e., with the knife switch 24 in the normally closed condition thereof, to start the electrically powered motor vehicle embodying the electrical circuit 72, a conventional key is inserted into the ignition key switch 74 and turned therein so as to cause the ignition switch 74 to move the closed condition thereof. The latter operation is performed in the same manner as is done with all key-operated ignition switches with which motor vehicles are commonly provided. Next the throttle switch 76, which assuming that the subject electrically powered motor vehicle comprises a motorcycle takes the form of a conventional type motorcycle twist grip, is twisted. The effect thereof is to cause the switch 76 to close thereby completing the circuit through the coil 94 of the contactor means 82 across the battery means 78. Upon completion of the latter described circuit, the coil 94 becomes energized causing the contactor means 82 to move to a closed circuit condition. With the contactor means 82 closed, a power connection is established between the electric motor 80 and the battery means 78. Consequently, the electric motor 80 begins to turn and thereby produce an output. The latter output in turn is employed to provide drive to the wheels of the electrically powered motor vehicle. Inasmuch as the manner in which the driving connection is accomplished between the output shaft of the electric motor 80 and the wheels of the electrically powered motor vehicle is well-known to those skilled in the art and is only indirectly related to the subject matter of the present invention, it is not deemed necessary to describe herein the specific manner in which this interconnection is accomplished. With the electrically powered motor vehicle being powered in the aforedescribed manner, should a failure occur in the operating controls of the motor vehicle necessitating an emergency interruption of the electrical power circuit, the latter interruption may be made to occur through operation of the disconnect means 10. Inasmuch as the manner in which the disconnect means 10 operates to effect an emergency interruption of an electrical power circuit has been previously described at length hereinabove, it is not deemed necessary for one skilled in the art to obtain an understanding of the present invention to reiterate at this point the aforereferenced description of the mode of operation of the disconnect means 10. Under normal operating conditions, assuming it is desired to shut off the motor 80 of the electrically powered motor vehicle, this may be accomplished merely by turning the key in the ignition key switch 74 to the OFF position which corresponds to the normal open condition of the latter thereby opening the circuit across the storage battery means 78 and causing a deenergization of the coil 94 of the contactor means 82 which in turn results in also opening the power circuit between the electric motor 80 and the storage battery means 78.

Although only one embodiment of a disconnect means constructed in accord with the present invention, which is particularly suited to be employed in connection with an electrically powered motor vehicle for purposes of effecting an emergency disconnect of the electrical power circuit thereof, has been shown in the drawings and described hereinabove, it is nevertheless to be understood that modifications in the construction thereof may be made thereto by those skilled in the art without departing from the essence of the invention. In this connection, some of the modifications, which can be made in the subject disconnect means have been alluded to hereinabove while others will become readily apparent to those skilled in the art when exposed to the present description and illustration of the disconnect means 10. For instance, although the grasping means 50 has been described hereinabove and depicted in the drawings as taking the form of a T-shaped handle, obviously the grasping means 50 could take some other form such as for example a lever mounted on the handlebars of a motorcycle for applications wherein the disconnect means 10 is embodied in an electrically powered motorcycle, without departing from the essence of the invention. Also, the construction of the pull cord 46 could take some form other than coaxial internal and external cables without departing from the essence of the invention. In this connection, any suitable means capable of operatively interconnecting the grasping means 50 with the clevis 42 so that movement of the former is transmitted to the latter may be substituted for the particular form of pull cord described herein. In addition, the plunger 60 could obviously be provided with an external configuration which was other than cylindrical without departing from the essence of the invention. Moreover, although not shown in the drawings, it is to be understood that preferably suitable bearing support means are mounted in the opposing wall members 14 and 20 of the enclosure means 12 wherein they are operative to provide support for the opposing ends of the plunger 60 as the latter moves between its release and reset positions.

Thus, it can be seen that the present invention provides a novel and improved disconnect means operable to effect an interruption in an electrical power circuit. Moreover, in accord with the present invention a disconnect means is provided which is particularly suited to be utilized in connection with an electrically powered motor vehicle for purposes of effecting an emergency disconnect of the electrical power circuit thereof when the normal operating controls of the vehicle have short-circuited, welded, burned out, etc. The disconnect means of the present invention is characterized in the fact that the disconnect means has no electrical dependency and therefore remains operative when all electrical power has failed or short-circuited in the electrically powered motor vehicle. Furthermore, in accord with the present invention a disconnect means has been provided which is further characterized in that the disconnect means can only be reset manually thereby obviating any possibility that an accidental resetting of the disconnect means could take place. In addition, the disconnect means of the present invention embodies means operable for providing a visual indication of the operating state of the disconnect means. Finally, in accord with the present invention a disconnect means has been provided which is of simple construction, easy to employ, relatively inexpensive to manufacture, and readily adaptable for employment in all forms of electrically powered motor vehicles.

Having thus described the invention, I claim:

1. A disconnect means employable in an electrical circuit for purposes of permitting an interruption of the electrical circuit to be effected through the operation thereof comprising:

a. enclosure means including a multiplicity of joined wall members operable as a housing for some of the operating components of the disconnect means:

b. first terminal means supported in said enclosure means, said first terminal means being adapted for connection in circuit relation with the electrical circuit;

c. second terminal means supported in said enclosure means in spaced relation to said first terminal means, said second terminal means being adapted for connection in circuit relation with the electrical circuit;

d. a knife switch supported on said first terminal means in electrical circuit relation therewith for movement relative to said second terminal means between a first position wherein said knife switch engages said second terminal means to complete an electrical circuit between said first terminal means and said second terminal means and a second position wherein said knife switch is spaced from said second terminal means thereby causing an open circuit condition to be established between said first terminal means and said second terminal means;

e. biasing means extending between said knife switch and one of said wall members operable for biasing said knife switch toward said second position thereof;

f. latching means cooperable with said knife switch and supported adjacent said second terminal means for movement between a first position wherein said latching means engages said knife switch when said knife switch is in the first position thereof to latch said knife switch in a closed circuit condition and a second position wherein said latching means is disengaged from said knife switch thereby freeing said knife switch for movement between said first position and said second position thereof in response to the force exerted by said biasing means;

g. actuator means operatively connected to said latching means extending outwardly of said enclosure means and manually operable for moving said latching means between said first position and said second position thereof, said actuator means comprising a pull cord operatively connected at one end to said latching means and having grasping means at the other end thereof, said grasping means being located externally of said enclosure means and h. reset means operatively connected to said knife switch comprising a plunger extending through one of said wall members of said enclosure means to provide an exposed portion adapted for effecting manual manipulation of said plunger, said plunger being mounted for reciprocating movement whereby movement of said knife switch from said first to said second positions thereof effects movement of said plunger in one direction and movement of said plunger in the opposite direction effects movement of said knife switch from said second to said first positions thereof.

2. The disconnect means as set forth in claim 1 further comprising arc-limiting means connected in electrical circuit relation between said first terminal means and said second terminal means.

3. The disconnect means as set forth in claim 1 wherein said first terminal means includes a terminal post operable for connecting said first terminal means to the electrical circuit and a substantially L-shaped member consisting of a first leg portion and a second leg portion joined integrally together so as to form a right angle therebetween, said terminal post being mounted on said first leg portion in electrical circuit relation therewith, said first leg portion being mounted on one of said multiplicity of wall members of said enclosure means, said second leg portion consisting of two segments joined together so as to form an opening therebetween with said knife switch being supported within said opening for pivotal movement relative to said two segments of said leg portion of said first terminal means.

4. The disconnect means as set forth in claim 3 wherein said second terminal means includes a terminal post operable for connecting said second terminal means to the electrical circuit and a substantially L-shaped member consisting of a first leg portion and a second leg portion joined integrally together so as to form a right angle therebetween, said terminal post of said second terminal means being mounted on said first leg portion of said second terminal means in electrical circuit relation therewith, said first leg portion of said second terminal means being mounted on said one of said multiplicity of wall members of said enclosure means in spaced relation to said first leg portion of said first terminal means, said second leg portion of said second terminal means consisting of two bifurcated segments capable of receiving therewithin in engaging relation therewith said knife switch when said knife switch is in said first position thereof.

5. The disconnect means as set forth in claim 4 wherein said latching means includes a clevis and a pivot pin mounting said clevis on said second leg portion of said second terminal means for movement between said first position and said second position of said latching means.

6. The disconnect means as set forth in claim 5, wherein said actuator means further includes a clevis return spring connected between said one end of said pull cord and said clevis operable for returning said clevis substantially to said first position thereof, and said grasping means comprises a T-shaped handle.

7. A disconnect means employable in an electrical circuit for purposes of permitting an interruption of the electrical circuit to be effected through the operation thereof comprising:

a. enclosure means including a multiplicity of joined wall members operable as a housing for at least some of the operating components of the disconnect means;

b. first terminal means supported in said enclosure means, said first terminal means being connected in circuit relation with the electrical circuit;

c. second terminal means supported in said enclosure means in spaced relation to said first terminal means, said second terminal means being connected in circuit relation with the electrical circuit;

d. a knife switch supported on said first terminal means in electrical circuit relation therewith for movement relative to said second terminal means between a first position wherein said knife switch engages said second terminal means to complete an electrical circuit between said first terminal means and said second terminal means and a second position wherein said knife switch is spaced from said second terminal means thereby causing an open circuit condition to be established between said first terminal means and said second terminal means;

e. latching means cooperable with said knife switch and supported on said second terminal means for movement between a first position wherein said latching means engages said knife switch when said knife switch is in the first position thereof to latch said knife switch in a closed circuit condition and a second position wherein said latching means is disengaged from said knife switch thereby freeing said knife switch for movement between said first position and said second position thereof;

f. actuator means operatively connected to said latching means and manually operable for moving said latching means between said first position and said second position thereof;

g. reset means operatively connected to said knife switch and manually operable for causing said knife switch to move between said second position and said first position thereof so as to effect a resetting of the disconnect means after the disconnect means has been actuated, said reset means comprising a cylindrical plunger and means interconnecting said knife switch and said cylindrical plunger so as to permit said knife switch and said cylindrical plunger to move together as a unit and so as to also permit relative movement to occur between said knife switch and said cylindrical plunger, said cylindrical plunger having one end thereof supported for movement in one of said multiplicity of wall members of said enclosure means and the other end thereof supported for movement in another of said multiplicity of wall members of said enclosure means located in opposed relation to said one of said multiplicity of wall members of said enclosure means; and h. biasing means operable for imparting a biasing force to said knife switch tending to bias said knife switch towards said second position thereof, said biasing means comprising a coil spring surrounding a portion of the length of said cylindrical plunger and having one end thereof seated against said one of said multiplicity of wall members of said enclosure means and the other end thereof bearing against said knife switch.

8. The disconnect means as set forth in claim 1 wherein said biasing means comprises a coil spring surrounding a portion of the length of said cylindrical plunger and having one end thereof seated against said one of said multiplicity of wall members of said enclosure means and the other end thereof bearing against said knife switch.

9. In an electrical power circuit for an electrically powered motor vehicle including at least an ignition key switch, battery means, an electric motor, contactor means including a coil and conductor means operable to connect said ignition key switch, said battery means and said coil of said contactor means in circuit relation to establish an electrical circuit therebetween and also operable to connect said electric motor, said contactor means and said battery means in circuit relation to establish a power circuit therebetween, the improvement of disconnect means embodied in the electrical power circuit so as to be operable to effect an emergency interruption when required of the electrical power circuit, said disconnect means comprising:

a. enclosure means including a multiplicity of joined wall members operable as a housing for some of the operating components of the disconnect means;

b. first terminal means supported in said enclosure means, said first terminal means being connected in electrical circuit relation with one side of the electric motor and with one side of the coil of the contactor means;

c. second terminal means supported in said enclosure means in spaced relation to said first terminal means, said second terminal means being connected in electrical circuit relation with one side of the battery means;

d. a knife switch supported on said first terminal means in electrical circuit relation therewith for movement relative to said second terminal means between a first position wherein said knife switch engages said second terminal means thereby being effective to complete an electrical circuit between said first terminal means and said second terminal means and a second position wherein said knife switch is spaced from said second terminal means thereby causing an open circuit condition to be established between said first terminal means and said second terminal means;

e. biasing means extending between said knife switch and one of said wall members operable for biasing said knife switch toward said second position thereof;

f. latching means cooperable with said knife switch and supported adjacent said second terminal means for movement between a first position wherein said latching means engages said knife switch when said knife switch is in said first position thereof to latch said knife switch in a closed circuit condition and a second position wherein said latching means is disengaged from said knife switch thereby freeing said knife switch for movement between said first position and said second position thereof in response to the force exerted by said biasing means;

g. actuator means operatively connected to said latching means extending outwardly of said enclosure means and manually operable for moving said latching means between said first position and said second position thereof, said actuator means comprising a pull cord operatively connected at one end to said latching means and having grasping means at the other end thereof, said grasping means being located externally of said enclosure means and adapted for mounting on the control panel of the vehicle; and h. reset means operatively connected to said knife switch comprising a plunger extending through one of said wall members of said enclosure means to provide an exposed portion adapted for effecting manual manipulation of said plunger, said plunger being mounted for reciprocating movement whereby movement of said knife switch from said first to said second positions thereof effects movement of said plunger in one direction and movement of said plunger in the opposite direction effects movement of said knife switch from said second to said first positions thereof.

* * * * *